US007631764B2

(12) United States Patent
Ginsberg et al.

(10) Patent No.: US 7,631,764 B2
(45) **Date of Patent: *Dec. 15, 2009**

(54) PACKAGE FOR A PERSONAL CARE PRODUCT

(75) Inventors: Steven Ginsberg, Montville, NJ (US); Bradford S. Grant, Bridgewater, NJ (US)

(73) Assignee: McNeil-PPC, Inc, New Brunswick, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/122,133

(22) Filed: May 16, 2008

(65) Prior Publication Data

US 2008/0290111 A1 Nov. 27, 2008

Related U.S. Application Data

(63) Continuation of application No. 11/353,733, filed on Feb. 14, 2006, now Pat. No. 7,434,692.

(60) Provisional application No. 60/652,839, filed on Feb. 14, 2005.

(51) Int. Cl.
*B65D 83/04* (2006.01)

(52) U.S. Cl. ..... 206/535; 206/499; 220/326

(58) Field of Classification Search ..... 206/1.5, 206/449, 499, 528–530, 532, 534–536, 538, 206/539; 220/255, 315, 324, 326, 810
See application file for complete search history.

(56) References Cited

U.S. PATENT DOCUMENTS 2,313,667 A * 3/1943 Peterson ..... 206/538
2,920,759 A 1/1960 Carnes
3,315,802 A 4/1967 Lonholdt, et al.
3,625,351 A 12/1971 Eisenberg
3,677,866 A 7/1972 Pickett
3,768,725 A 10/1973 Pilaro
3,826,222 A 7/1974 Romick ..... 206/534
4,498,591 A 2/1985 Smith, II
4,645,077 A 2/1987 McLaughlin et al. ..... 206/449
4,720,011 A 1/1988 Canamero ..... 206/455
4,811,845 A 3/1989 Baggett ..... 206/534
4,884,718 A 12/1989 Leahy
4,889,238 A 12/1989 Batchelor ..... 206/534

(Continued)

FOREIGN PATENT DOCUMENTS

DE 4334023 4/1995

(Continued)

OTHER PUBLICATIONS

Barex Barrier Resins Barrier Properties; 2000 BP p.l.c.; BX555B; Feb. 2000.

(Continued)

*Primary Examiner*—Luan K Bui
(74) *Attorney, Agent, or Firm*—Karen G Horowitz

(57) ABSTRACT

An embodiment of the present invention provides a packaged supply of individual doses of a personal care product, such as strips of a water-soluble film that may or may not contain a pharmaceutically active material, including a dispenser apparatus including a tray, cover and side portions and at least one packet freely positioned within the dispenser apparatus.

19 Claims, 9 Drawing Sheets

U.S. PATENT DOCUMENTS

| | | | | |
|---|---|---|---|---|
| 4,932,547 | A | 6/1990 | Rodriguez | |
| RE33,880 | E | 4/1992 | Yamazaki et al. | 383/200 |
| 5,415,276 | A | 5/1995 | Welton | |
| 5,419,437 | A | 5/1995 | Huseman | 383/37 |
| 5,613,779 | A | 3/1997 | Niwa | |
| 5,630,546 | A | 5/1997 | Velch | |
| 5,655,653 | A | 8/1997 | Chester | |
| 5,791,540 | A | 8/1998 | Sage | |
| 5,836,444 | A | 11/1998 | Hoevel et al. | |
| 5,931,304 | A | 8/1999 | Hammond | 206/425 |
| 6,173,838 | B1 | 1/2001 | Brozel | 206/538 |
| 6,177,391 | B1 | 1/2001 | Zafar | |
| 6,199,698 | B1 | 3/2001 | Hetrick et al. | 206/532 |
| 6,247,595 | B1 | 6/2001 | Omata et al. | 206/534.2 |
| 6,293,403 | B1 | 9/2001 | Holmberg | 206/534 |
| 6,326,069 | B1 | 12/2001 | Barnett et al. | 428/35.7 |
| 6,516,950 | B1 | 2/2003 | Robertson | 206/539 |
| 6,568,533 | B1 | 5/2003 | Tanaka et al. | 206/484 |
| 6,575,627 | B2 | 6/2003 | Huseman et al. | 383/38 |
| 6,596,298 | B2 | 7/2003 | Leung et al. | 424/435 |
| 6,619,479 | B2 | 9/2003 | Jones et al. | 206/554 |
| 6,708,826 | B1 | 3/2004 | Ginsberg et al. | |
| 6,776,284 | B2 | 8/2004 | Mamiye | 206/425 |
| 6,776,288 | B2 * | 8/2004 | Kopecky | 206/538 |
| 2002/0094942 | A1 | 7/2002 | Danneels et al. | |
| 2003/0054034 | A1 | 3/2003 | Leung et al. | |
| 2003/0136698 | A1 | 7/2003 | Klatt | 206/534 |
| 2003/0224044 | A1 | 12/2003 | Weibel et al. | 424/465 |
| 2004/0055903 | A1 | 3/2004 | Nishimura et al. | 206/1.5 |

FOREIGN PATENT DOCUMENTS

| | | |
|---|---|---|
| FR | 2599716 | 6/1986 |
| FR | 2643238 | 2/1989 |
| GB | 717950 A1 | 2/1953 |
| GB | 1475080 | 12/1973 |
| GB | 1559843 | 8/1976 |
| WO | 9005683 | 5/1990 |
| WO | 03037727 | 5/2003 |
| WO | 03094823 | 11/2003 |

OTHER PUBLICATIONS

Surlyn Properties & Performance Overview; 2002 E.I. du Pont De Nemours & Co.

* cited by examiner

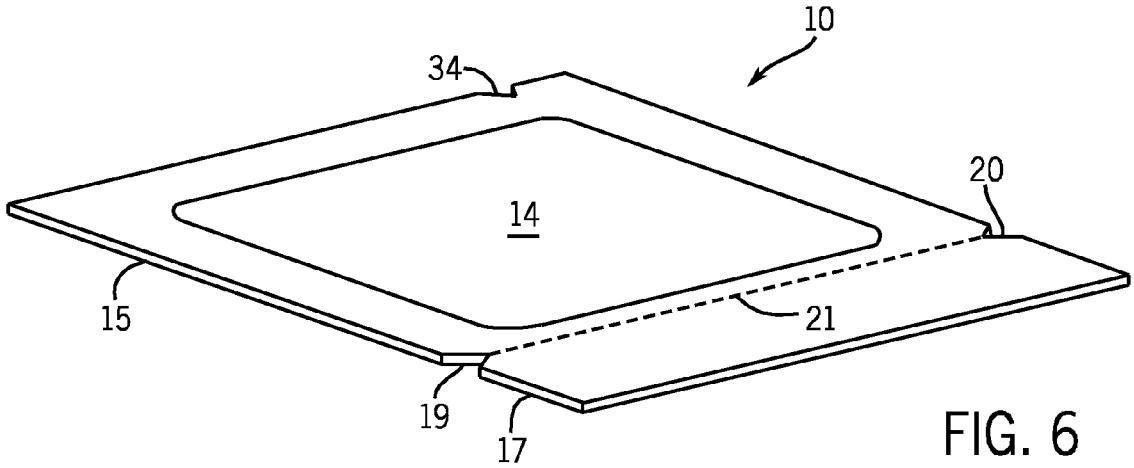
FIG. 6
FIG. 7
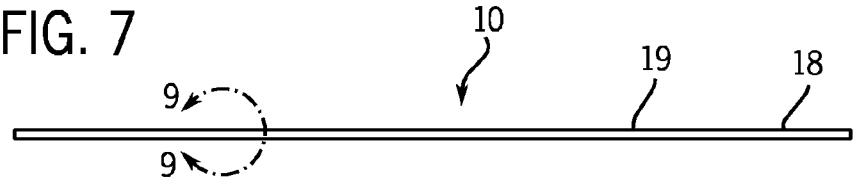
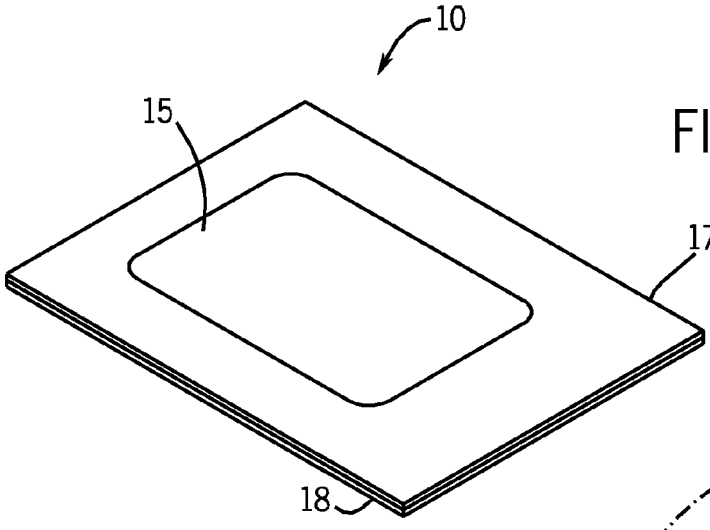
FIG. 8
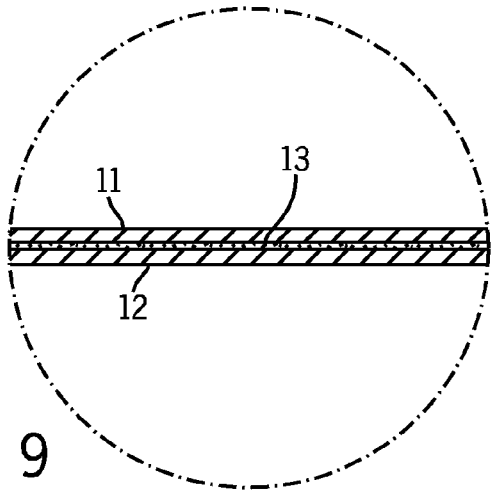
FIG. 9

FIG. 13A–1
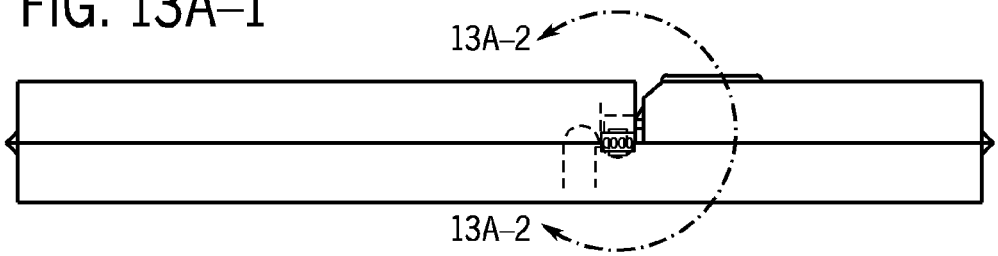
FIG. 13A–3
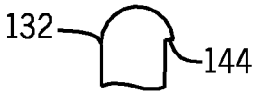
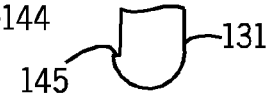
FIG. 13A–4
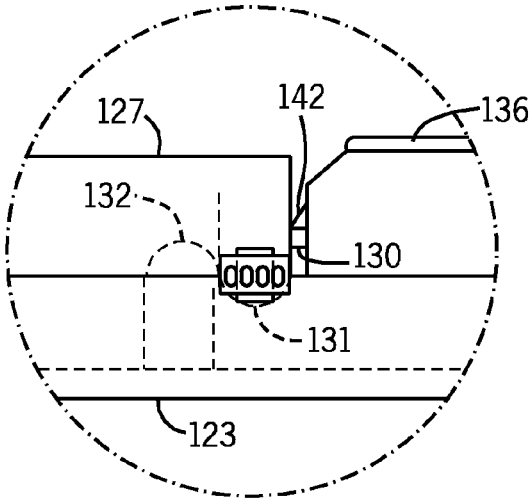
FIG. 13A–2
FIG. 13B–2
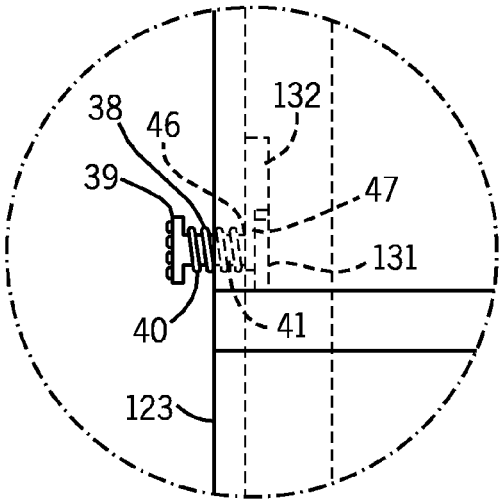
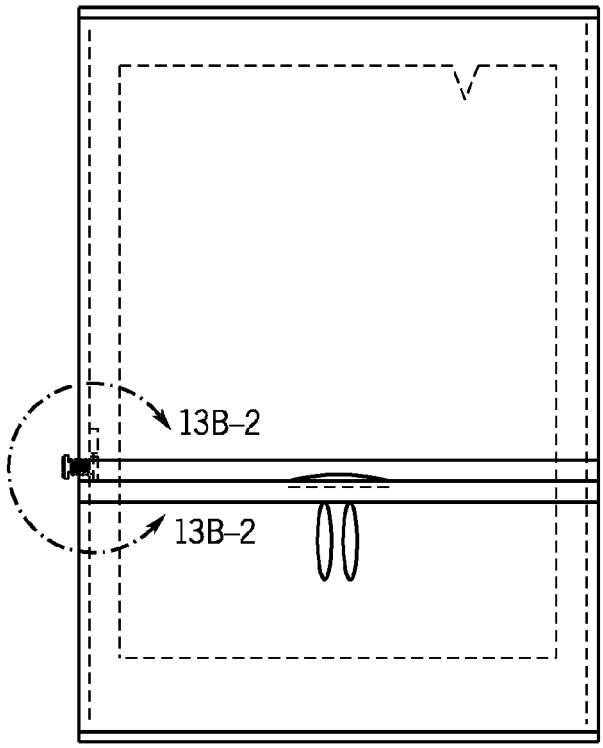
FIG. 13B–1

PACKAGE FOR A PERSONAL CARE PRODUCT

CROSS-REFERENCE TO RELATED APPLICATIONS

This application is continuation of and claims the benefit of U.S. patent application Ser. No. 11/353,733, filed Feb. 14, 2006, now U.S. Pat. No. 7,434,692 B2, granted on Oct. 14, 2008, which patent claims the benefit of U.S. provisional patent application 60/652,839, filed Feb. 14, 2005, which applications are incorporated by reference herein in their entireties.

FIELD OF INVENTION

This invention concerns a packaged supply of individual doses of a personal care product.

BACKGROUND

Personal care products can be formulated in individual dosage units, e.g., as tablets or capsules to be swallowed, as lozenges or strips of water-soluble film to be allowed to dissolve in the mouth, or as strips of bioadhesive film composition for treating wounds. Sometimes it is important that each dose be segregated from the others—i.e., that the doses not all be held in the same bottle or vial. This might be the case, for example, if the formulation can be deleteriously affected by humidity, e.g., if the formulation is hygroscopic. Also, if the form of the dosage is such that the patient could easily, and unknowingly, take two dosage units at one time, when only a single unit was prescribed, it might be desired to package each dose individually. The present invention is directed to a convenient, effective way of providing an individually wrapped dosage form.

SUMMARY

An embodiment of the present invention provides a package including a packaged supply of individual doses of a personal care product including a dispenser comprising a bottom portion and a first end and a second end; a cover portion comprising a fixed partial cover coupled to the first end and a movable partial cover coupled to the second end, at least one packet freely positioned in the dispenser, the packet having a pouch portion that holds a personal care product; said dispenser having a releasable portion to allow the packet to be removed.

Another embodiment of the present invention provides for a package such as a packaged supply of individual doses of a personal care product, including a dispenser comprising a bottom portion; side portions coupled to the bottom portion; a cover portion opposing to the bottom portion, the cover portion comprising a fixed partial cover portion coupled to a first end of the side portion; and a movable partial cover portion coupled to a second end of the side portion a releasable opening provided between the fixed partial cover portion and the movable partial cover portion; at least one packet freely positioned in said dispenser, the packet having a pouch portion that holds a personal care product; wherein the packet may be removed from the dispenser through an opening formed by moving the movable partial cover portion from a closed position to an open position.

Another embodiment of the present invention provides for a package, such as a packaged supply of individual doses of a personal care product, including a tray; at least one packet stacked in said tray, the packet having a pouch portion that holds a personal care product; a cover that is movably connected to the tray, the cover being movable between a closed position in which the packets are enclosed within the tray and an open position in which the pouch portion of the topmost packet on the stack is exposed so that the packet can be removed from the tray. In various embodiments, the package may include at least two packets.

Another embodiment provides for a kit including an outer package and an inner package. The inner package may be housed in the outer package. The inner package may include a dispenser which includes a bottom portion and a first end and a second end; a cover portion including a fixed partial cover coupled to the first end and a movable partial cover coupled to the second end. At least one packet may be freely positioned in the dispenser. The packet may have a pouch portion that holds a personal care product. The dispenser may have a releasable portion to allow the packet to be removed.

BRIEF DESCRIPTION OF DRAWINGS

The invention perhaps will be better understood by considering the accompanying drawings, which depict illustrative embodiments of the invention. Referring to the drawings:

FIG. 6 is a perspective view of a packet according to various embodiments of the present invention.

FIG. 7 is a side view of a packet according to various embodiments of the present invention.

FIG. 8 is a top perspective view of a packet according to various embodiments of the present invention.

FIG. 9 is an enlarged cross-sectional view of segment 9-9 of the packet of FIG. 7.

FIG. 12A-1 is a side view of a dispenser with a movable cover slightly open according to various embodiments of the present invention.

FIG. 12A-2 is an enlarged view of segment 12A-2-12A-2 of FIG. 12A-1.

FIG. 12B-1 is a side view of a dispenser with a movable cover closed according to various embodiments of the present invention.

FIG. 12B-2 is an enlarged view of segment 12B-2-12B-2 of FIG. 12B-1.

FIG. 13A-1 is a side view of a dispenser according to various embodiments of the present invention.

FIG. 13A-2 is an enlarged view of segment 13A-2-13A-2 of FIG. 13A-1.

FIG. 13A-3 is a side view of the dog 132 that is shown in FIG. 13A-2 according to various embodiments of the present invention.

FIG. 13A-4 is a side view of the dog 131 that is shown in FIG. 13A-2 according to various embodiments of the present invention.

FIG. 13B-1 is a top view of a dispenser according to various embodiments of the present invention.

FIG. 13B-2 is an enlarged view of segment 13B-2-13B-2 of FIG. 13B-1.

FIG. 14B-1 is a perspective view of a dispenser with a cover slightly open according to various embodiments of the present invention.

FIG. 14B-2 is an enlarged view of segment 14B-2-14B2 of FIG. 14B-1.

DETAILED DESCRIPTION

Figure 1:
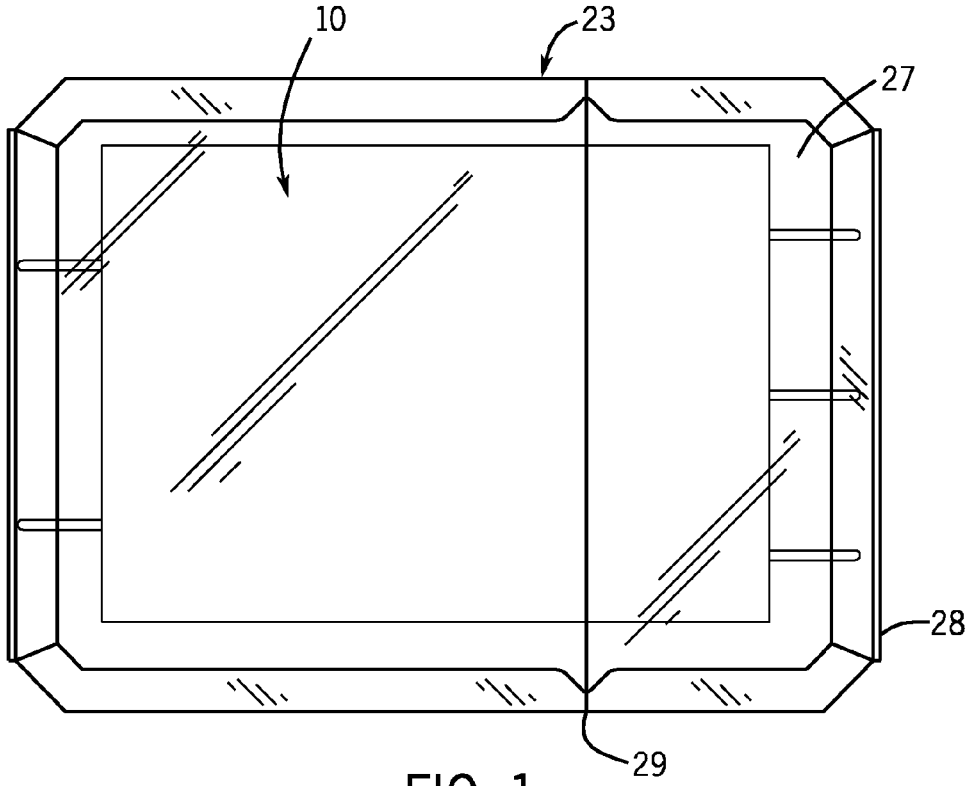
FIG. 1 is a top plan view that shows a closed dispenser with a stack of packets shown inside according to various embodiments of the present invention.

In several embodiments of the present invention, the packet is comprised of two flexible sheets that are coupled together by an adhering or sealing means. The sealing means can be any suitable method that connects the two sheets together, including but not limited to lamination, heat sealing, adhesives and combinations thereof. In several embodiments, the sealing means occupies a limited area near the perimeter of the sheets, thereby leaving a space inside the packet, a pocket that does not have an adhering means. In one embodiment, the sealing means is water and air resistant or impermeable.

Useful materials for the sheets include but are not limited to one or more layers of foil, plastic film, and/or paper and the like and combinations thereof. A useful metal foil includes aluminum foil. Suitable plastic films include poly(ethylene terephthalate) (PET), polyolefin, acrylonitrile polymers, and copolymers of ethylene and an ethylenically unsaturated carboxylic acid, e.g., acrylic acid. Suitable polyolefins include nucleated polypropylene, low density polyethylene, and high density polyethylene. Suitable acrylonitrile polymers include copolymers of acrylonitrile and methyl acrylate, e.g., the Barex® barrier resins. Suitable ethylene/unsaturated acid copolymers include those wherein the acid groups are partially neutralized particular ions such as zinc or sodium ions. Examples of such copolymers include Nucrel® and Surlyn® packaging resins manufactured by Dupont, Wilmington, Del. Suitable paper includes wax paper.

In the pocket area, a consumer product or a personal care product may be located. Useful consumer products or personal care products include a pill, capsule, tablet, capsule, caplet, film, a wafer, granules, powder, a gum, or a chewable tablet.

In various embodiments of the present invention, the packet is freely associated within the tray and cover. In such embodiments, packets are restrained in the tray by the cover. The tray of the apparatus dispenser may include guides or edges that are useful to keep the packets in a particular area of the apparatus to prevent shifting of the packets. The consumer may remove a packet by opening the releasable means such as the releasable cover or side portion, and removing the individual packet from the tray.

In other embodiments, the packet is adhered to at least one section of the tray or cover by an adherence means such as those described in U.S. Pat. No. 6,708,826, which is incorporated herein in its entirety. The tab portion and pouch portion of each packet may be connected by various means, e.g., by releasable adhesive strips, by hook and loop fastener strips, or by the two portions being constructed out of one sheet of material (on each side) and that material being thin enough that the pouch portion can be torn away from the tab portion. Thus, the pouch portion and tab portion can meet at a boundary zone along which the two portions can be torn apart by tearing or pulling, thereby releasing the pouch portion from the tray.

In several embodiments the sheets of the packet may include any suitable tear apart means. Suitable tear apart means include a packet with two sheets wherein at least one side of the packet has two flaps that when pulled apart from each other open up the pouch area to allow access to the consumer product, such as a film strip. Another embodiment of the present invention provides a tear apart means where a boundary zone has a tear-facilitating means that tend to confine the tear line to that zone when the pouch portion is torn away from the tab portion. Useful tear-facilitating means include a score line in the sheet material, a perforated line therein, and a tear-directing notch in an edge of the packet on at least one end of the packet, such as in a boundary zone. If a boundary zone contains a layer of paper, preferably a perforated line will be used. A score line or a perforated line may be used and may run across part or the entire width of the packet. It is possible to have a perforated line on the interior of the boundary zone so that if the sheet is folded on the perforated line, the sheets of a packet may be easily torn. If a tear-directing notch is used, preferably two will be employed, one at each end of the boundary zone. A tear-directing notch can be either a simple slit in the sheet material or a gap created by the removal of material, e.g., in a V shape.

To assist keeping a tear line straight as it traverses across the width of the packet—i.e., keep it in the boundary zone—sheet material that tears more easily in one direction may be used. Thus, for example, the sheet material may be oriented or striated film.

In the tear-apart embodiment, a minor portion of each pocket may extend into the packet's boundary zone so that when the pouch portion is torn, the pocket is automatically opened along the tear line. A single act of tearing the pouch portion away from the tab portion serves also to open that end or edge of the pocket. Sometimes, however, if the pocket is only opened at that one edge, it may be difficult to withdraw the product. To assist withdrawal of the consumer product, additional tear means may be utilized. For example, additional space adjacent to the pocket area may be added to the pouch and pull tab areas may be added so as to assist the consumer in pulling the two sheets apart from each other. Alternatively, an additional tear means may be provided in the boundary zone of another edge of the packet. For example, another edge, such as the front edge of the pouch portion can have tear-facilitating means that enable the pouch portion, once released from the tray, to be manually torn into two segments along a second tear line, one that extends from the pouch's front edge to the tear line created when the pouch was pulled away from the tab portion. The pocket may straddle this second tear line, so that when the released pouch portion is torn in two, along that line, the pocket is further opened. The second tear line may divide the pocket into a major area and a minor area, with the major area constituting about two-thirds or more of the total area of the pocket, e.g., 75 or 80% thereof. In this way, the product will be less likely to fall out of the pocket, and maybe onto the floor, as the second tear line is being created.

In various embodiments, a personal care product in strip form is located in the pocket in a center position away from both tear lines, e.g., to center it in the pocket. In that way, the strip will be protected from damage.

Apparatus, container, assembly or dispenser is used herein interchangeably to refer to the object that houses the packet (s). The dispenser apparatus may be constructed in any desired shape, e.g., rectangular, oval, round, trapezoidal, triangular, or irregular. For efficiency reasons, the apparatus may conform to the packet shape, at least approximately, the outline of the packets stacked within the tray. Since it generally is more economical to manufacture such packets in rectangular shapes, it follows that one embodiment of the present invention has the shape of the apparatus and packets in a rectangular shape. The packets and the pockets can be in any shape, but they will be generally more convenient, easier and cheaper to manufacture if they both conform, in shape, to each other and the apparatus.

In several embodiments, the dispenser assembly may be small enough and thin enough that it can readily fit in a purse or pocket. Useful dimensions of the apparatus or tray and cover combination include a thickness in the range of about 0.25 to about 1 inch, a width of about 1 to about 5 inches, and a length of about 1 to about 5 inches. In one embodiment, the assembly has a thickness of about 0.5 inch, a width of about 2 inches, and a length of about 3 inches.

In some embodiments, the dispenser apparatus may include a tray portion coupled to a cover. In some embodiments the dispenser apparatus includes a tray portion coupled to side portions and coupled to a cover portion. The cover may be a single entity or the cover may include a partial fixed cover portion and a releasable or movable cover portion. The releasable cover portion may open towards the fixed cover portion or towards one of the side portions or the tray portion of the dispenser. In several embodiments, the partial cover portions have a free edge that is intermediate the two ends of the tray. In some embodiments, the cover may include at least one fixed cover partial portion and a releasable partial cover portion. The releasable partial cover portion(s) may also be releasably connected to the side portions or the tray portions. Any releasable means may be used to releasably connect the partial cover portion with the other portions, e.g. the fixed partial cover portion, the side portions or the tray portion. Useful releasable means include an overlapping layer or an interconnecting layer or a pressure release latch mechanism or combinations thereof. The partial cover portions may be situated so that they interlock with each other so that pressure applied to the end of the fixed partial cover portion adjacent to the releasable cover portion will release the releasable cover portion thereby opening the dispenser apparatus and allowing access to the packet(s). The fixed cover portion may be fixedly attached to the tray portion or the side portions by any suitable means such as a push and snap fitting system.

In other embodiments, the tray and cover portions are fixed or stationary and at least one side portion located between the cover and tray is releasably connected that allows removal of the consumer product. Yet in still further embodiments, the cover may include multiple portions, wherein one or more parts are releasably connected to the tray and/or side portion of the apparatus. Further embodiments provide for part of the cover and side and tray to be movable so as to allow access to the packet.

The movable cover can be slidably mounted on the tray and or side portion of the apparatus or it can be hingedly connected thereto. If a fixed partial cover also is used, preferably an edge of the movable cover will rest against the free edge of the fixed cover when in the closed position. If a hinge is used to connect the movable cover to the tray, it can be on either side of the tray, or at an end of the tray, or, if a partial fixed cover is used, the movable cover can be hingedly connected to that, at the free edge of the fixed cover. Useful hinges include a living hinge wherein the entire dispenser is formed into a single molded entity. Additional useful hinges include a hook and pin hinge.

In another embodiment, the device will include releasing or latch means for releasably holding the movable cover in the closed position. Any such means can be used, including, for example, a swingable latch, a slidable latch, or an interfering-fit latch. A particularly useful arrangement is where the partial fixed cover is used and the movable cover is hingedly connected to the tray, for example along one of the sides or at the end opposite the fixed cover. In this arrangement the latch preferably is of such a design that it can be released by thumb pressure on the top of the fixed cover. Preferably the design is such that such downward pressure will not only cause the latch to release but also cause the movable lid to pop open. Even if it pops only slightly open, that will be beneficial, in that it will make it easier to grasp the moving edge of the cover with the tip of one's forefinger and pull the cover all the way open.

In another embodiment, the device may be child-proof Useful child proof devices may include at least two means for securing the cover and or side portion to the tray, which need to be released to enable access to the consumer product. In one embodiment, the at least two securing means need to be released in a one step action that occurs at about the same time to enable access to the consumer product. Useful releasing means include a latch mechanism that requires application of two different forces at once, in order to open the movable cover. For example, in addition to the pressure-release latch on the top of the fixed cover, there can be a second pressure-release latch that has to be simultaneously activated, in order for the movable cover to be opened. The second latch may be located, for example, on one of the sides of the tray or on the side portion of the tray, in such a manner that, to release the movable cover, finger or thumb pressure has to be simultaneously applied to both the top of the fixed cover and the side of the tray. With such an arrangement one can grip the tray in one hand, with the thumb and forefinger on opposite sides of the tray, and, with the other hand, simultaneously press down on a cover portion with thumb pressure to release the other latch.

In several embodiments, tactile indicators may be added to the dispenser in strategic locations. Strategic locations include desirable areas where the consumer should place their fingers on the dispenser to assist in holding and opening the dispenser. In particular, strategic locations include on the side portions, fixed or releasable cover portions. More particularly, strategic locations include on the partial fixed cover portion where pressure is to be applied to enable the releasable partial cover portion to be opened. Useful tactile indicators include raised bumps, or raised elongated rectangular type ribs, or the like and combinations thereof.

The packets may be retained in the tray or may be freely placed in the tray. If a retention means is used, useful retention means include a clamping mechanism, posts where part of the pocket has one or more holes that allow the packets to be mounted on one or more posts. Posts can be attached to the bottom of the tray and/or, if they are located underneath a partial fixed cover, they can be attached to the underside of the fixed cover. Alternatively, pockets may be glued or adhesivetaped to the tray. Clamping mechanisms can either be normally engaged or normally nonengaged. If normally nonengaged, they can be designed so that they are engaged by throwing a lever or applying pressure, e.g., thumb or finger pressure.

The apparatus may be made of any suitable material including but not limited to plastic, metal, cardboard, glass and combinations thereof. Suitable plastics include polyolefins, such as homopolymers or copolymers of propylene, e.g., propylene-butylene random copolymers. The plastic may be transparent or opaque. In one embodiment, the pouch portion of each packet may be imprinted so that the imprint will be visible through a transparent cover. Such an embodiment would make it unnecessary to incur the cost of also printing on the movable cover or, if one is used, the fixed cover. In one embodiment, the ingredient information and directions for using the product be printed on the bottom surface of each packet.

As shown in FIGS. 6-9, each packet 10 is constructed of top and bottom sheets 11 and 12, each having a thickness of 0.004" and being made of a laminate of PET, aluminum foil, and a heat-sealable polymer. The layers of heat-sealable polymer face each other, so that the two sheets are bonded together by being heated under pressure, to a temperature at which those two coatings fuse together, forming adhesive layer 13, e.g., as shown in FIG. 9.

As depicted in FIGS. 6 and 8, adhesive layer 13 does not extend into the center area 14 of the pouch portion 15. Thus a pocket is formed between sheets 11 and 12 in the center area 14, in which a strip 16 of a personal care product is enclosed.

Useful personal care products include medication-dosed film-forming materials that dissolve in the mouth such as those disclosed in U.S. Pat. No. 6,596,298 by Leung et al., issued Jul. 7, 2003, which is incorporated herein by reference. Useful personal care products include films including films that include a water soluble polymer. Useful water soluble polymers include pullulan, hydroxypropylmethyl cellulose, hydroxyethyl cellulose, hydroxypropyl cellulose, polyvinyl pyrrolidone, carboxymethyl cellulose, polyvinyl alcohol, sodium alginate, polyethylene glycol, xanthan gum, tragacanth gum, guar gum, acacia gum, arabic gum, polyacrylic acid, methylmethacrylate copolymer, carboxyvinyl polymer, amylose, high amylose starch, hydroxypropylated high amylose starch, dextrin, pectin, chitin, chitosan, levan, elsinan, collagen, gelatin, zein, gluten, soy protein isolate, whey protein isolate, casein and combinations thereof.

Such a film might contain one dose of an oral medication, e.g., an adult dose of 15 mg. of dextromethorphan, a cough suppressant, homogeneously distributed throughout the strip. Alternatively, a children's dose of 7.5 mg. can be used.

Another type of product that can be held in the pocket between sheets 11 and 12 is a wound-treating composition in the form of a film. Such films are disclosed, for example, in U.S. Pat. No. 6,329,343 B1, issued Dec. 11, 2001, which also is incorporated herein by reference.

Pouch portion 15 of each packet is connected to flap portions 17 and 18. V notches 19 and 20 are in the boundary zone between pouch portion 15 and tab portion 17 of the packet. The notches define an imaginary tear line 21, shown as a broken line in FIG. 6.

As shown in FIGS. 1-5, a packet 10 is freely positioned in tray 23. Movable cover 27 is connected to tray 23 by a living hinge 28 at the front edge of tray 23. The free edge of fixed partial cover 26 ends in a down turned lip 29. The unhinged moving edge 35 of cover 27 rests against or coacts with lip 29 when cover 27 is closed.

Figure 3:
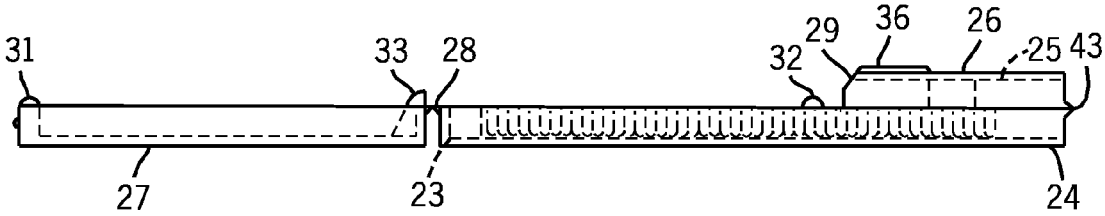
FIG. 3 is a side elevation view of a package and packets, but with a movable cover in the fully open position according to various embodiments of the present invention.
Figure 4:
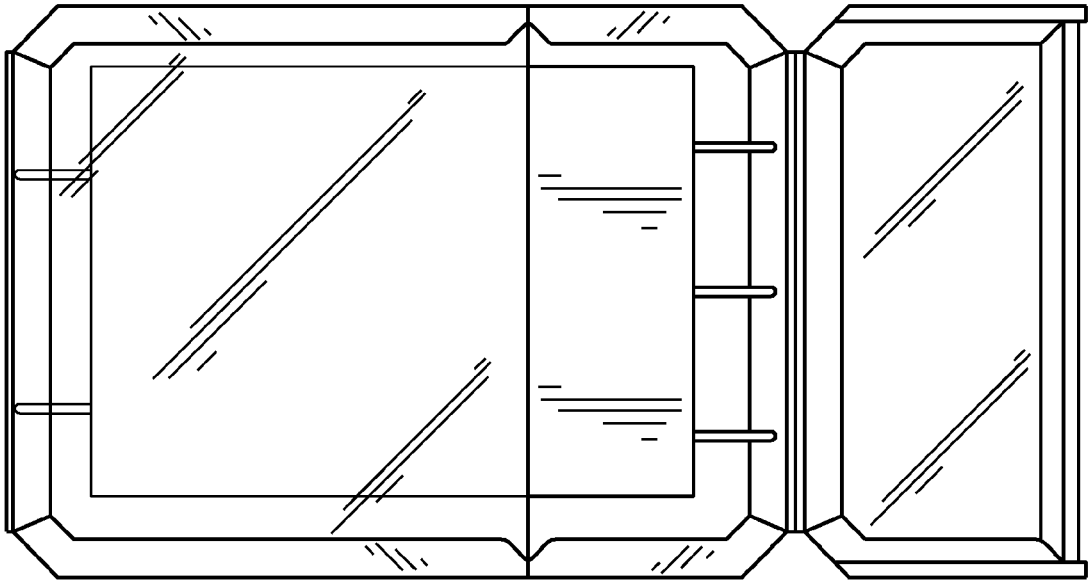
FIG. 4 is a top view of the dispenser with a cover in an open position according to various embodiments of the present invention.
Figure 5:
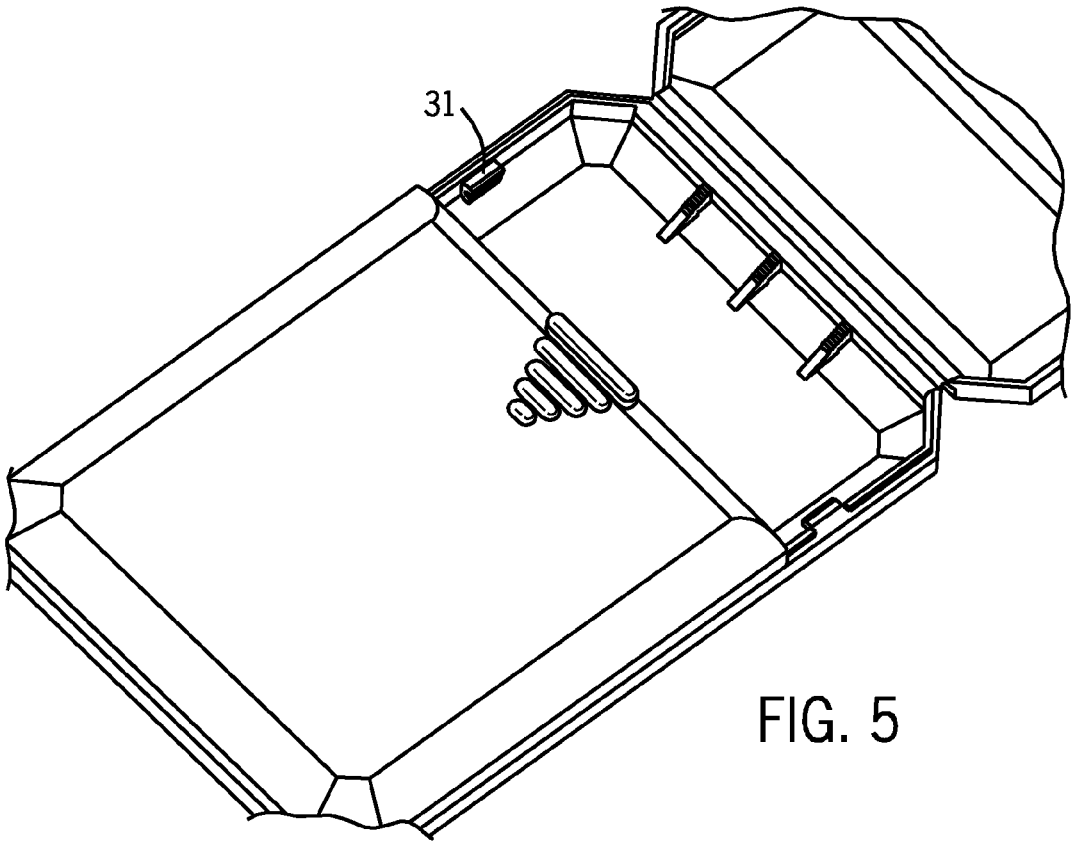
FIG. 5 is a perspective view of the dispenser with a cover in an open position according to various embodiments of the present invention.
Figure 10:
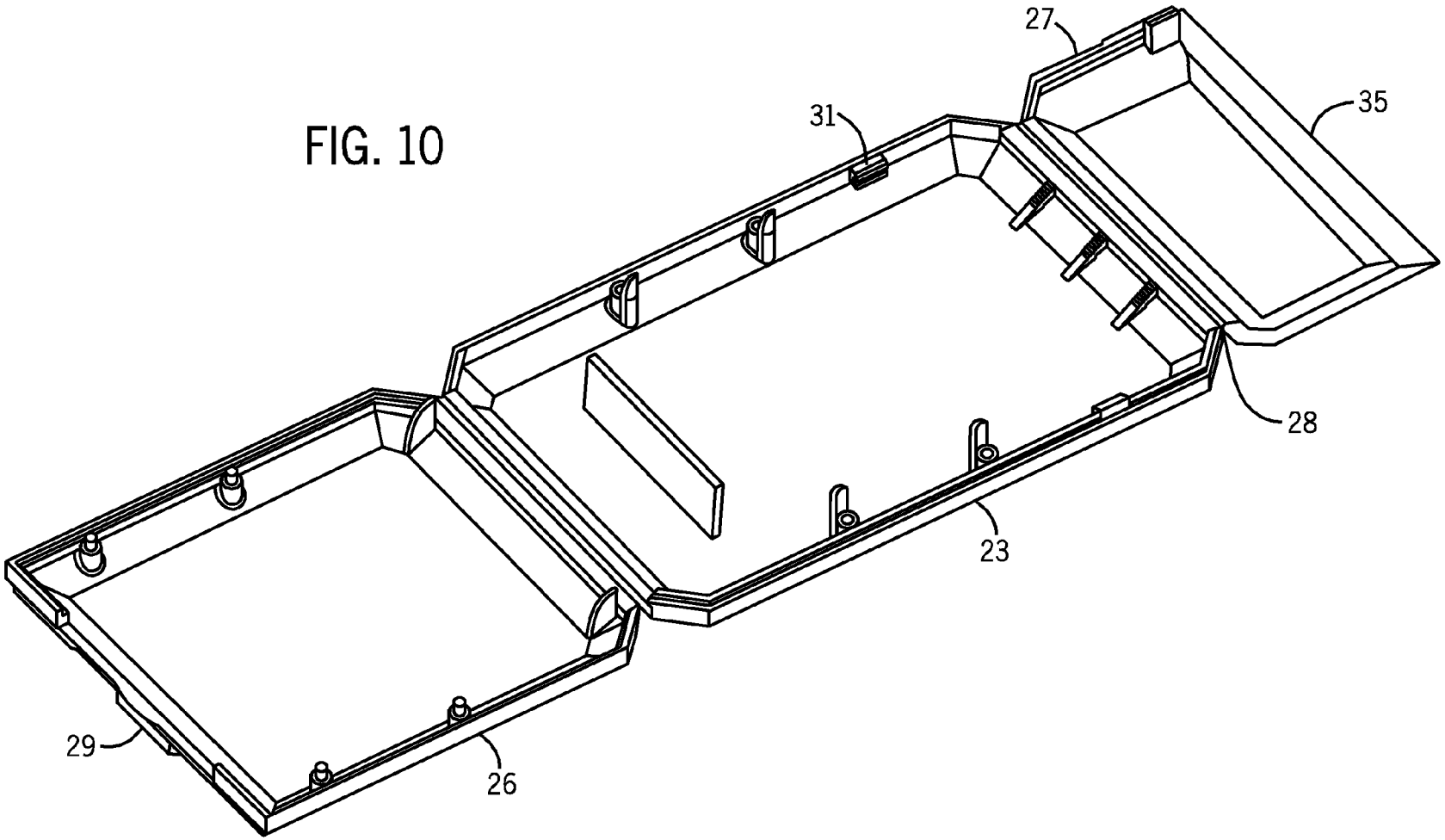
FIG. 10 is a top perspective view of the inside of a dispenser present in various embodiments of the present invention.
Figure 11:
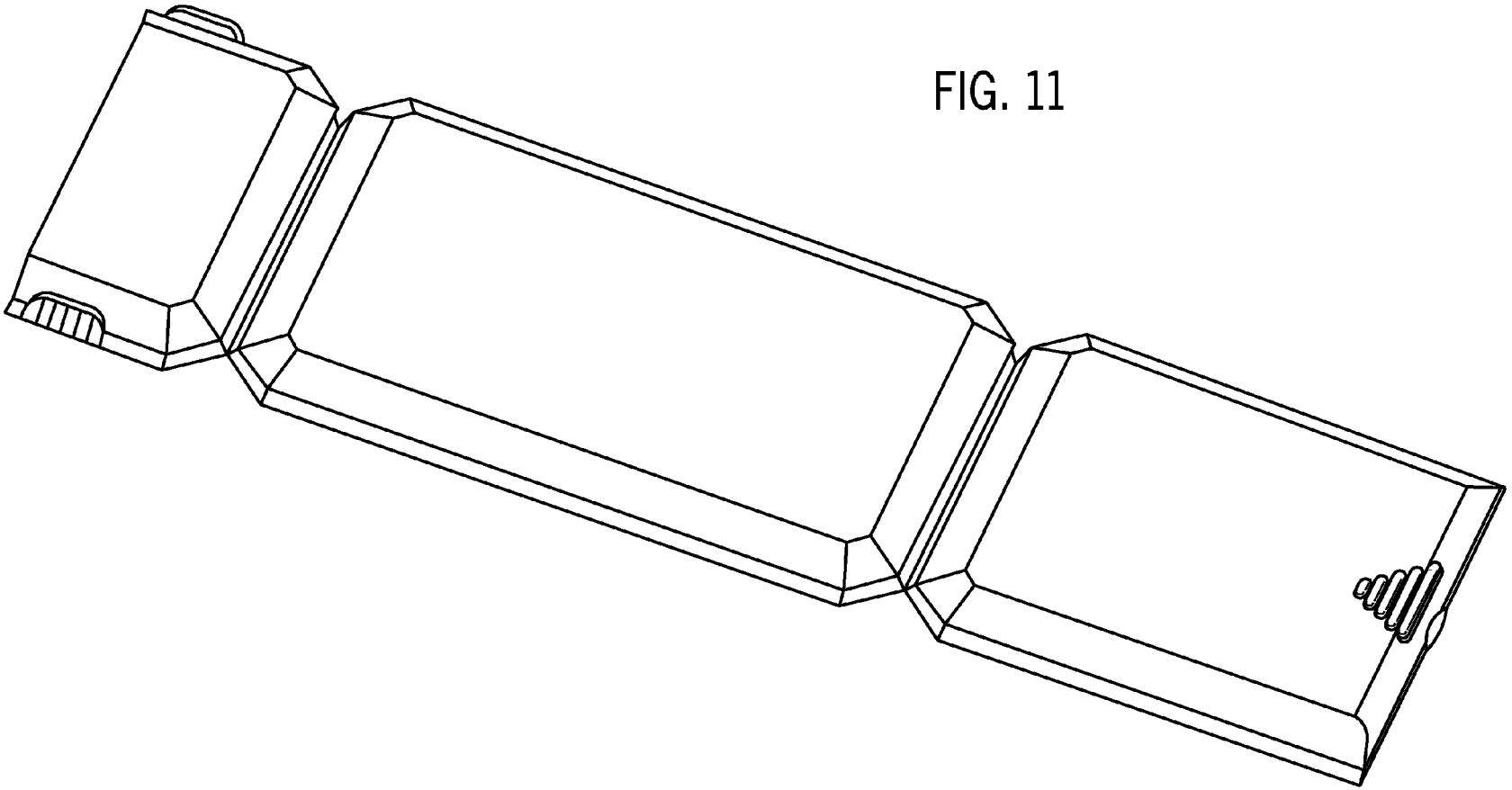
FIG. 11 is a top perspective view of the outside of a dispenser present in various embodiments of the present invention.

When cover 27 is open, as shown in FIGS. 3-5, the packet 10 can be gripped between thumb and forefinger or otherwise removed from the dispenser. The packet may be opened by pulling apart flaps 17 and 18 to expose pouch portion 15.

In one embodiment of pouch 10, as shown in FIG. 8, tear notches 19 or 20 are located on packet 10 and can be torn to allow access to center area 14 of pouch 15.

To help align movable cover 27 with fixed cover 26 when in the closed position, cover 27 is equipped with dogs 31, near the unhinged moving edge of cover 27. Dogs 31 extend upwardly from the inside walls of tray 23.

Figure 2:
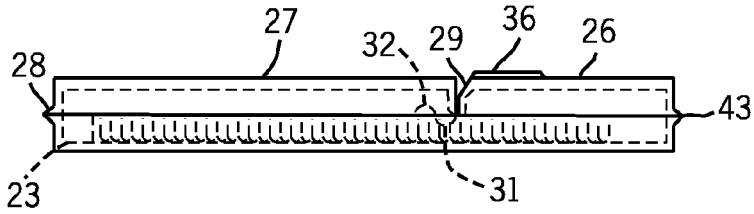
FIG. 2 is a side elevation view of a dispenser and packets according to various embodiments of the present invention.
Figures 1, 12A:
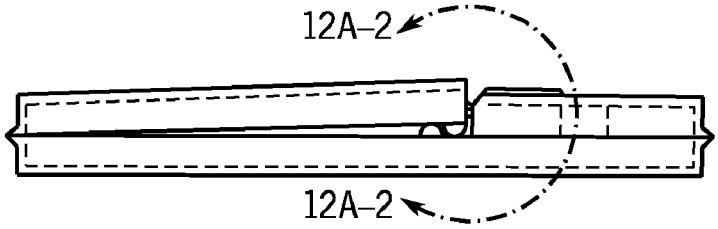
Figures 2, 12A:
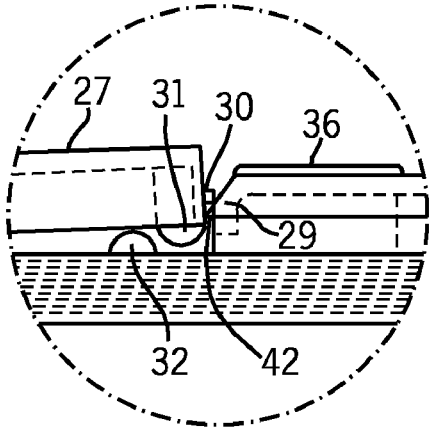
Figures 1, 12B:
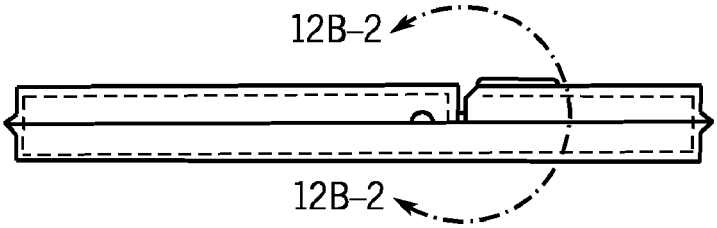
Figures 2, 12B:
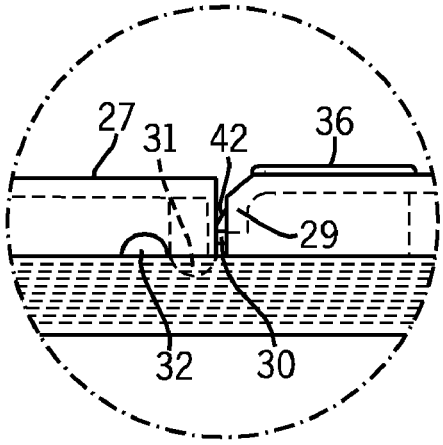

As shown in FIGS. 12A-1, A-2, B-1, and B-2, the mechanism for holding lid 27 closed is a combination of wedge-shaped overhang 42 that protrudes from the vertical front of down-turned lip 29, and tongue member 30 on movable lid 27. When lid 27 is forced into its closed position, tongue member 30 rides down and past overhang 42 and nests beneath overhang 42, as shown in FIG. 12B-2. The flexibility of the plastic of which the parts are made permits the tongue member 30 to be forced down and past overhang 42. Similarly, the flexibility of fixed cover 26 allows it to be pressed down by thumb pressure at the tread-like protrusions 36 with sufficient force to drive overhang 42 below tongue member 30, thereby releasing lid 27.

Figure 14A:
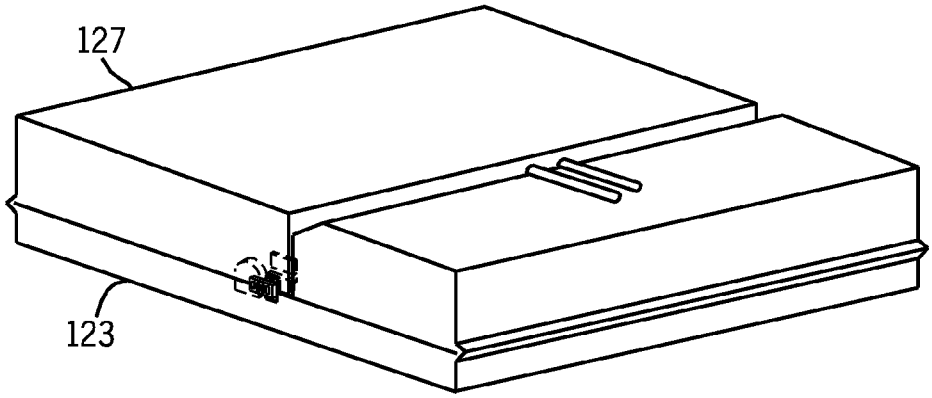
FIG. 14A is a perspective view of the container with a movable cover in the closed position according to various embodiments of the present invention.
Figures 1, 14B:
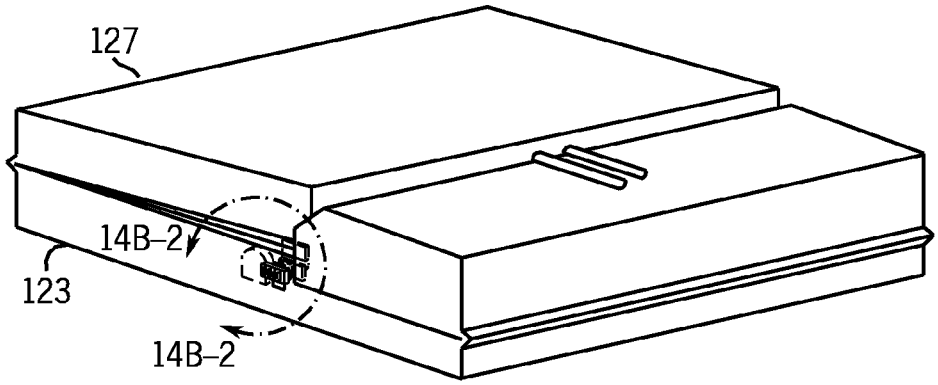
Figures 2, 14B:
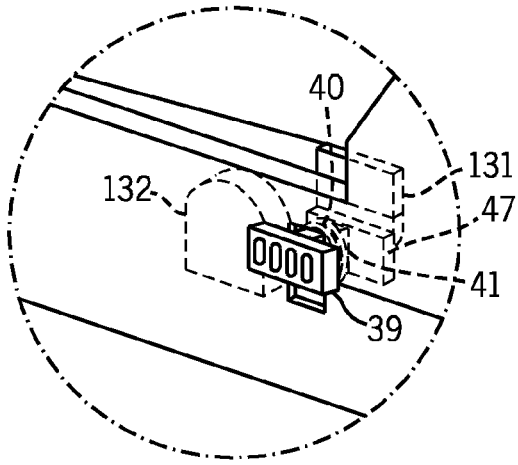

In the embodiment shown in FIGS. 13 and 14, dogs 131 and 132 have complementary undercuts 145 and 144, respectively, which cause dogs 131 and 132 to hook together, as shown in FIG. 13A-2, when movable cover 127 is closed. Dog 131 is sufficiently flexible, however, that it can be bent inward sufficiently far to cause it to unlatch from dog 132. Headed rectangular shaft 41 is held in hole 46 in the sidewall of tray 123. It is prevented from falling out by textured head 39 and foot plate 47. Coil spring 40 normally urges head 39 away from tray 123, thus allowing dog 131 to hook underneath undercut 144 of dog 132. To unlatch the mechanism, finger or thumb pressure can be applied to head 39, as shown in FIGS. 14B-1 and 14B-2. This pushes the round bottom of dog 131 inward, sufficiently far to unhook from dog 132. If, at the same time, thumb or finger pressure is applied downwardly on protrusions 136, overhang 142 will be driven below tongue member 130, and cover 127 will pop open.

Figure 15:
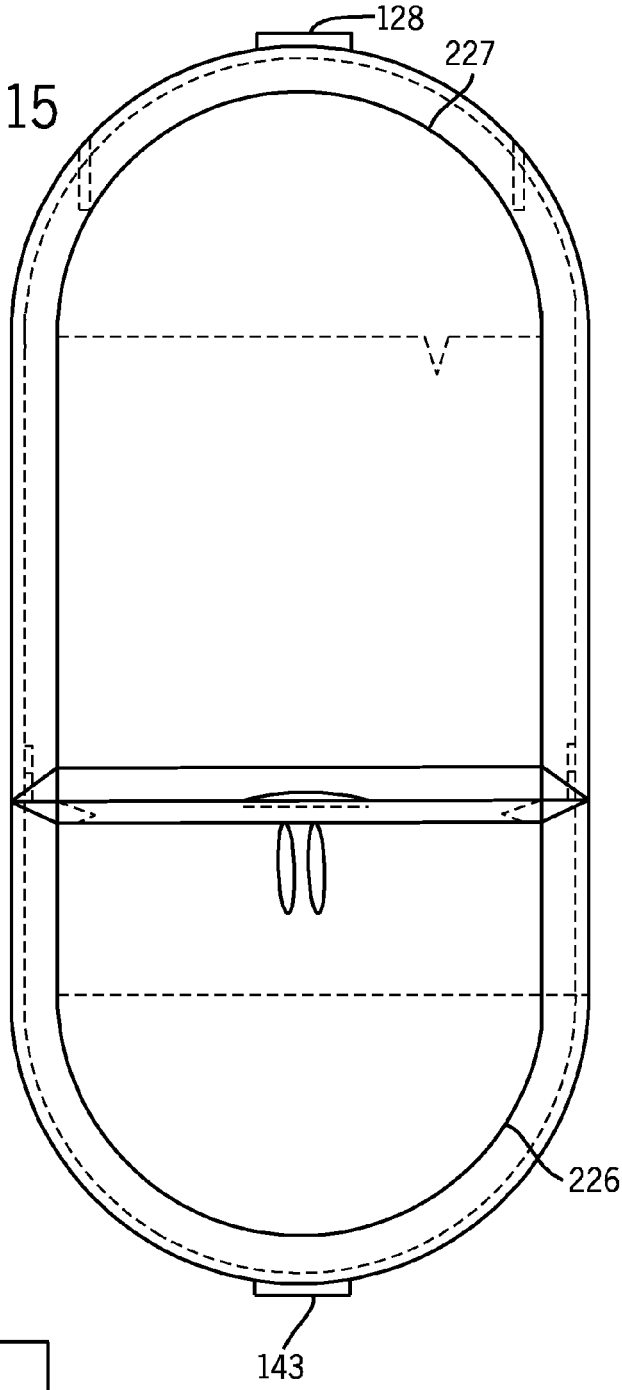
FIG. 15 is a top view of another embodiment of a dispenser according to various embodiments of the present invention.
Figure 16:
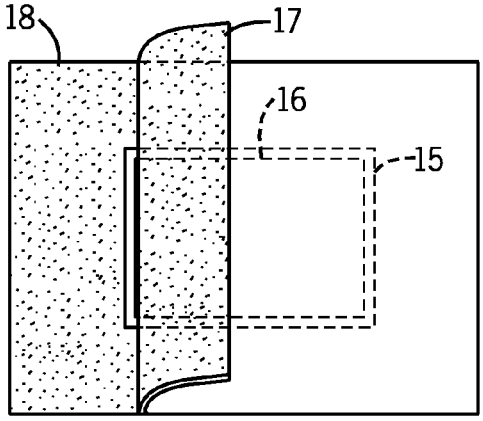
FIG. 16 is a top view of a packet in the open position exposing the pocket and the consumer product located in the packet according to various embodiments of the present invention.

In FIG. 15, the container is structured essentially the same as in FIG. 1, except that it is oval rather than rectangular. Living hinges 128 and 143 are appropriately shorter, to permit movable cover 227 to swing open and closed and to permit fixed cover 226 to be opened for the loading of the packets into the container.

Another embodiment of the present invention provides for a kit that includes an outer package and an inner package. The inner package is housed in the outer package. The outer package may be comprised of cardboard, plastic, shrink wrap and the like or combinations thereof. The outer package may have a window that may be a transparent plastic that allows the inner package to be viewed while the outer package is not open. The outer package and/or the inner package may include drug facts for active pharmaceutical ingredients as required by regulatory authorities.

The inner package may include a personal care product. The personal care product may be contained in a packet. The packet may be freely positioned in the inner package. The inner package may include a dispenser that may include a bottom portion and a first end and a second end, a cover portion including a fixed partial cover coupled to the first end and a movable partial cover coupled to a second end. The inner package may include at least one packet freely positioned in the dispenser and the packet may have a pouch portion that holds a personal care product. The dispenser may have a releasable portion to allow the packet to be removed.

The inner package may also include a packaged supply of individual doses of a personal care product. The packaged supply may include a dispenser that may include a bottom portion and a first end and a second end, a cover portion including a fixed partial cover coupled to the first end and movable partial cover coupled to a second end. The package supply may include at least one packet freely positioned in the dispenser and the packet may have a pouch portion that holds a personal care product. The dispenser may have a releasable portion to allow the packet to be removed.

While the invention has been explained by a detailed description of certain specific embodiments of it, it is to be understood that various modifications and/or substitutions may be made without departing from the spirit of the invention. Accordingly, the invention should not be deemed limited by the detailed description of the embodiments set out above, but only by the following claims.

We claim:

1. A package comprising:

a) a dispenser comprising a bottom portion and a first end and a second end; and a cover portion comprising a fixed partial cover coupled to the first end and a movable partial cover coupled to the second end and releasably attached to said fixed partial cover via at least one latch holding said movable partial cover in a closed position; and b) at least two packets freely positioned in said dispenser, each said packet having a pouch portion that holds a personal care product in the form of a film;

wherein:

each said packet is freely movable within said dispenser such that upon moving said movable partial cover to access the interior of said dispenser, each said packet is freely releasable from said dispenser; and said at least one latch is released and said movable partial cover pops open by pressing down on a portion of said fixed partial cover.

2. The package of claim 1, wherein said movable partial cover is releasably attached to said bottom portion.

3. The package of claim 1, wherein said at least one latch releasably holds said movable partial cover to said fixed partial cover.

4. The package of claim 1, wherein:

each packet comprises two flexible sheets that are partially laminated together so as to define a closed pocket between said sheets; and said personal care product is located in said pocket.

5. The package of claim 1, wherein each said packet comprises two sheets and a separating means.

6. The package of claim 5, wherein said separating means comprise two pull tabs on said sheets located on at least one side of said packet.

7. The package of claim 5, wherein said separating means comprise at least one tear-facilitating means.

8. The package of claim 7, wherein said tear-facilitating means is selected from the group consisting of a score line, a perforated line, and a tear-directing notch in an edge of the packet, at an end of a boundary zone.

9. The package of claim 5, wherein each sheet is comprised of material that more easily tears in the direction of a boundary zone than in directions perpendicular thereto and comprises material selected from the group consisting of oriented film and striated film.

10. The package of claim 1, wherein each said packet is generally rectangular in shape.

11. The package of claim 1, wherein the personal care product comprises an active pharmaceutical ingredient.

12. The package of claim 11, wherein said active pharmaceutical ingredient is chosen from phenylepherine, nicotine, cetirizine, dextromethorphan, diphenhydramine, chlorpheniramine, benzocaine, famotidine, and combinations thereof.

13. The package of claim 1, wherein:

said fixed partial cover is fixedly connected to said first end; and said movable partial cover is hingedly connected to said second end so that, when said movable partial cover is in its closed position, an edge of said movable partial cover rests against the free edge of said fixed partial cover.

14. The package of claim 1, wherein said at least one latch provides an interference fit between said movable partial cover and said fixed partial cover, said at least one latch being engaged by pressing said movable partial cover into its closed position.

15. The package of claim 14, wherein said at least one latch and a second latch have to be simultaneously pressed in order to open said movable partial cover.

16. The package of claim 1, wherein a surface of each said packet is imprinted with indicia selected from the group consisting of the name of the personal care product, a lot number, a product indicating code and combinations thereof.

17. The package of claim 1, wherein each said packet comprises two flexible flat sheets coupled together to form said pouch portion therebetween shaped to hold said personal care product in the form of a film in a flat strip form.

18. The package of claim 1, wherein:

said first end of said dispenser is opposite said second end of said dispenser; and said fixed partial cover is fixedly coupled to said first end of said dispenser.

19. A package comprising:

a) a molded tray;

b) at least two packets freely stacked in said tray, each said packet comprising two flexible flat sheets coupled together to form a pouch portion therebetween, said pouch portion containing a single dose of a personal care product in the form of a flat film strip;

c) a cover that is movably coupled to said tray, said cover being movable between a closed position in which said packets are enclosed within said tray and restrained within said tray only by said cover and an open position in which said pouch portion of the topmost packet on the stack is exposed and said at least two packets are free to be removed from said tray;

wherein:

said package has (i) a thickness, in a direction from said tray to said cover, of about 0.25 to about 1 inch; (ii) a width, substantially perpendicular to said thickness, of about 1 to about 5 inches; and (iii) a length, substantially perpendicular to said thickness and said width, of about 1 to about 5 inches; so that said package is small and thin enough to fit readily in a purse or pocket;

said cover comprises a fixed partial cover coupled to a first end of said tray and a movable partial cover coupled to a second end of said tray and releasably coupled to said fixed partial cover; and said cover is selectively opened by pressing down on a portion of said fixed partial cover to move said movable partial cover with respect to said fixed partial cover.

* * * * *